United States Patent [19]

Herten

[11] Patent Number: 4,703,882

[45] Date of Patent: Nov. 3, 1987

[54] PRESS FOR APPLYING ARTICLES OF HARDWARE TO GARMENTS AND THE LIKE

[75] Inventor: Ernst Herten, Stolberg, Fed. Rep. of Germany

[73] Assignee: William Prym-Werke GmbH & Co. KG., Stolberg, Fed. Rep. of Germany

[21] Appl. No.: 818,791

[22] Filed: Jan. 14, 1986

[30] Foreign Application Priority Data

Jan. 16, 1985 [DE] Fed. Rep. of Germany ..... 3501224

[51] Int. Cl.[4] ..... D41H 37/04

[52] U.S. Cl. ..... 227/8; 227/15; 227/18; 227/30; 227/149

[58] Field of Search ..... 227/8, 15, 18, 30, 114, 227/116, 149

[56] References Cited

U.S. PATENT DOCUMENTS

| | | | |
|---|---|---|---|
| 1,901,386 | 3/1933 | White | 227/149 |
| 2,377,263 | 5/1945 | Peterson | 227/18 |
| 4,378,900 | 4/1983 | Sauermilch | 227/8 |
| 4,592,501 | 6/1986 | Sodeno et al. | 227/119 |

FOREIGN PATENT DOCUMENTS

| | | | |
|---|---|---|---|
| 2556516 | 6/1977 | Fed. Rep. of Germany . | |
| 2941685 | 4/1981 | Fed. Rep. of Germany | 227/149 |
| 1066520 | 6/1954 | France | 227/15 |

*Primary Examiner*—Howard N. Goldberg
*Assistant Examiner*—Taylor J. Ross
*Attorney, Agent, or Firm*—Peter K. Kontler

[57] ABSTRACT

A riveting press wherein the female component of a composite button, knob or a like article of hardware is introduced between the jaws of first tongs below a sheet of textile material whose marked side faces upwardly, and wherein the male component of the article is introduced between the jaws of second tongs at a level above the sheet. The first tongs deposit the female component on a stationary anvil while the second tongs descend toward the upper side of the sheet to place the male component into the path of movement of a descending ram which causes a deformable part of the male component to penetrate through the sheet and to be deformed into permanent engagement with the female component by a centering stud which is provided on the anvil. The mechanism which moves the first tongs up and down derives motion from the mechanism which moves the second tongs and the ram.

29 Claims, 12 Drawing Figures

PRESS FOR APPLYING ARTICLES OF HARDWARE TO GARMENTS AND THE LIKE

CROSS-REFERENCE TO RELATED CASE

The machine of the present invention constitutes an improvement over and a further development of the riveting press which is disclosed in commonly owned U.S. Pat. No. 4,541,558 granted Sept. 17, 1985.

BACKGROUND OF THE INVENTION

The present invention relates to machines for assembling composite articles of hardware, e.g., for securing complementary male and female components of buttons, rivets, eyelets, hooks, knobs and like metallic or synthetic plastic articles to sheets of penetrable material, especially to sheets of textile material which form part of garments or the like. More particularly, the invention relates to improvements in riveting presses and like machines of the type disclosed in the commonly owned copending application Ser. No. 599,176, now U.S. Pat. No. 4,659,001.

The copending application Ser. No. 599,176 discloses a riveting press wherein a male first component of an article of hardware is placed onto a fixed lower tool and a sheet of textile material is placed onto a platform which is movable up and down with reference to the lower tool. The press further comprises tongs for releasably holding a female second component of the article of hardware at a level above the sheet of textile material on the platform, and an upper tool in the form of a ram which can cause the second component to descend and to be impaled on an upwardly extending protuberance of the first component on the lower tool. The platform has an opening for the lower tool and is moved downwardly by the descending tongs to thereby move the sheet of textile material toward the first component. The placing of the male first component (this component is visible on the finished garment which embodies the sheet of textile material) onto the stationary lower tool presents several problems, primarily because the indicia which facilitate the application of articles of hardware to garments or the like are invariably applied to the outer side of the garment, i.e., to that side of the sheet of textile material which faces downwardly when an article of hardware is to be applied in the just discussed riveting press. While the tongs can properly hold and orient the female component during movement toward the upper side of the garment which overlies the platform, the orientation of the male component is not as satisfactory as if the male component were positively held while the platform descends and the female component is in the process of descending toward the upper side of the garment.

The application of indicia to the rear or inner side of a garment is time-consuming and cannot always be effected with a requisite degree of precision so that the assembled articles of hardware are not applied with a degree of accuracy which is desirable for utilitarian purposes (e.g., if the article of hardware is a knob) or for purely decorative purposes.

OBJECTS AND SUMMARY OF THE INVENTION

An object of the invention is to provide a novel and improved machine for applying composite articles of hardware to sheets of textile material or the like which renders it possible to apply such articles with a maximum degree of accuracy even though the indicia need not be applied to the rear sides of the sheets.

Another object of the invention is to provide a riveting press wherein the visible or exposed component of each applied article of hardware can be located at a level above the sheet of textile material during attachment of such component to the sheet and to the other component.

A further object of the invention is to provide a riveting press which can reliably hold both components of a composite article of hardware during each and every stage of transport of such components to the locus of attachment to each other as well as at the locus.

An additional object of the invention is to provide novel and improved tools for use in a machine of the above outlined character.

Still another object of the invention is to provide a novel and improved drive for the mobile constituents of tools in the above outlined machine.

A further object of the invention is to provide a novel and improved method of applying composite articles of hardware to sheets of textile material or the like in such a way that the exposed or outer side of the sheet can face upwardly and can be observed by the operator during delivery of components to the riveting station.

Another object of the invention is to provide a riveting press wherein the components of articles of hardware can be locked in optimum positions during certain stages of movement of the riveting and retaining tools relative to each other.

A further object of the invention is to provide a riveting press wherein the means for supplying components of articles of hardware to the riveting station occupy little room and the components of such articles are positively held and properly oriented during each and every stage of their delivery to the riveting station so that the number of rejects is reduced to zero or to a fraction of the number of rejects in a conventional riveting press.

The improved machine is designed to secure complementary male and female components of articles of hardware to each other at opposite sides of sheet-like workpieces, especially to apply male and female components of buttons, rivets or the like to textile materials. The machine comprises first tongs having a first pair of jaws for releasably holding one component (e.g., the male component) of an article of hardware, second tongs having a second pair of jaws for releasably holding the other component of such article of hardware (the first and second tongs have confronting surfaces which provide a space for insertion of a workpiece therebetween), an anvil in line with the component between the jaws of the second pair, a ram in line with the component between the jaws of the first pair, and drive means for moving the first and second tongs and the ram relative to each other and with reference to the anvil so as to effect the penetration of the male component through the workpiece which is located between the first and second tongs and into engagement with the female component as a result of movement of the ram toward the anvil.

The anvil and the second tongs are preferably located at a level below the first tongs and the ram. The jaws of the first pair have first sockets for portions of the one component, and the jaws of the second pair have second sockets for portions of the other component. The first tongs further comprise means (e.g., a coil spring) for yieldably urging the (first) sockets of the jaws of the first pair toward each other so that the surfaces which surround the first sockets normally clamp the one component between the jaws of the first pair. Analogously, the second tongs further comprise means (e.g., a coil spring) for yieldably urging the (second) sockets of the jaws of the second pair toward each other so that the surfaces which surround the second sockets normally clamp the other component between the jaws of the second pair. The machine can further comprise a mobile support (e.g., a pivotable platform) and means for pivotally securing the jaws of the second pair to the support. The drive means then comprises means for moving the second tongs up and down through the medium of the support. The means for moving the second tongs preferably comprises means for depositing the other component on the anvil, and the drive means further comprises means for thereupon lowering the ram and the first tongs so that the one component overlies the other component and the ram causes a portion (e.g., a deformable hollow shank) of the male component to penetrate through the workpiece (which is located between the first and second tongs) and to engage the female component. Such machine further comprises means for spreading the jaws of the second pair apart during downward movement of the second tongs so that the jaws of the second pair release the other component while the other component is supported by the anvil. The spreading means can be provided on the anvil. The anvil preferably further comprises means for centering the other component while the other component rests on the anvil, particularly after the other component is released by the jaws of the second pair.

The means for moving the support for the jaws of the second pair preferably derives motion from the means for moving the first tongs and/or from the means for moving the ram. In accordance with a presently preferred embodiment, the means for moving the support for the jaws of the second pair comprises an elongated arm for the support, a pivot for the arm, and means (e.g., an elongated motion transmitting member in the form of a rod or the like) for pivoting the arm and the support with the second tongs in response to predetermined stages of movement of the ram with reference to the anvil. The means for moving the ram can comprise a lever having a first arm which is coupled to the ram and a second arm, a pivot member for the lever, and an eccentric which is coupled to the second arm by a strap and serves to rock the lever. The aforementioned motion transmitting member of the means for moving the support in response to certain stages of movement of the ram can comprise portions which are slidably telescoped into each other so as to allow for changes in the effective length of the motion transmitting member and hence for movements of the ram and the second tongs relative to each other.

The other component of each article of hardware can be provided with a centrally located opening which receives the centering means of the anvil when the other component is deposited on the anvil. The aforementioned deformable portion of the male component (normally the one component) engages the centering means while the latter extends into the opening of the other component and is thereby deformed in response to downward movement of the ram toward the anvil. The centering means can comprise an upright stud which has a substantially conical tip for convenient penetration into the opening of the other component. Such stud extends upwardly beyond the upper side of the anvil, and the latter preferably includes a substantially cylindrical portion which is adjacent to the upper side and is coaxial with the stud.

Each jaw of the first pair preferably comprises a gripper which is provided with the aforementioned first socket for a portion of the one component, and an extension. The first tongs preferably further comprise a carrier for the jaws of the first pair, pivot means for securing the jaws of the first pair to the carrier so that the respective gripper and the respective extension are located at the opposite side of the corresponding pivot means, and the aforementioned means (coil spring) for yieldably urging the grippers (i.e., the first sockets) toward each other. Such machine preferably further comprises means for blocking the movements of the grippers away from each other through the medium of the extensions during predetermined stages of movement of the first tongs. The blocking means is or can be provided on the means for moving the first tongs and/or on the means for moving the ram. The arrangement is preferably such that the blocking means prevents the grippers from moving away from each other (i.e., from releasing the one component between the jaws of the first pair) during a predetermined stage of each movement of the ram toward the anvil and/or during a predetermined stage of each movement of the first tongs toward the anvil.

The machine preferably further comprises a safety device for preventing downward movement of the first tongs toward the second tongs if and when the first tongs encounter an object other than a workpiece in the space between the first and second tongs. The safety device can comprise means for arresting the drive means in response to an interruption of downward movement of the first tongs as a result of the presence of an object (e.g., a finger or a hand) in the space between the first and second tongs.

The aforementioned blocking means can comprise a boss or an analogous enlargement which shares the movements of the ram relative to the anvil. The extensions of the jaws of the first pair preferably include adjustable portions (e.g., in the form of bolts or screws whose tips can be moved nearer to or further away from each other) which are engaged by the boss while the latter blocks the movements of the grippers away from each other.

The machine further comprises first feeding means for supplying discrete components between the jaws of the first pair, and second feeding means for supplying discrete components between the jaws of the second pair in predetermined positions of the respective tongs. The first and second feeding means define predetermined first and second paths for the respective components, and at least a portion of one of these paths is inclined with reference to at least a portion of the other path. For example, such portions of the two paths can extend at right angles to each other. This entails considerable savings in space requirements of the two feeding means. The jaws of the first and second pairs are preferably disposed in two mutually inclined planes. For example, such planes can be disposed at right angles to each other, the plane of the jaws of the first pair can be substantially vertical, and the plane of the jaws of the second pair can be substantially horizontal.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
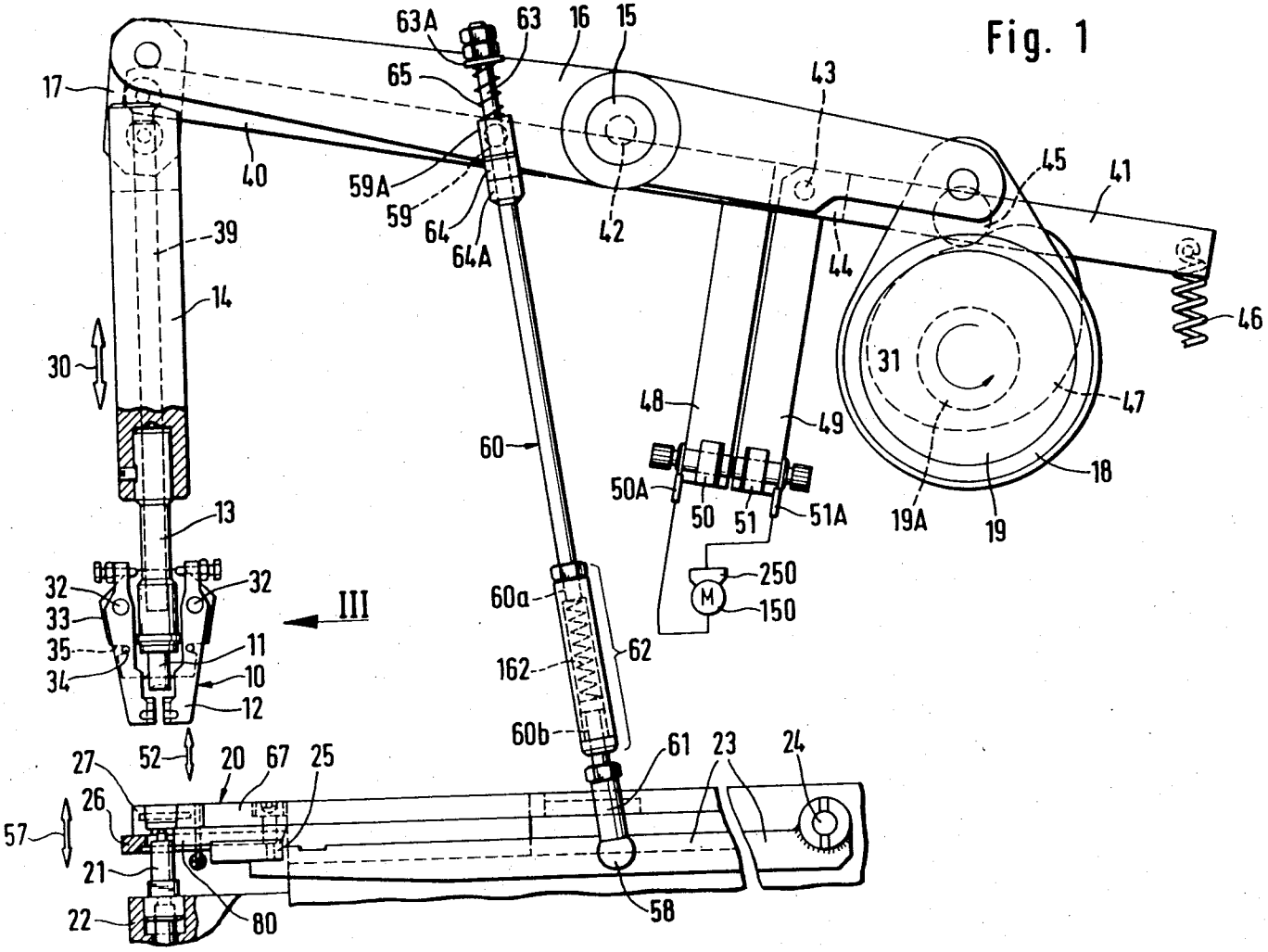
FIG. 1 is fragmentary schematic side elevational view of a machine which constitutes a riveting press and embodies the invention, certain parts being shown in section and the tongs and the ram being shown in their upper end positions.

Referring first to FIG. 1, there is shown a portion of a riveting press which comprises a housing or frame 22 for the units which serve to secure complementary female and male components 70, 90 (FIGS. 2, 4, 6, 7) of rivets, buttons or like articles of hardware to each other in such a way that portions of the coupled components 70 and 90 are disposed at opposite sides of a sheet-like workpiece 100 (see FIG. 7), particularly a layer of textile material which can constitute or form part of a jacket, a skirt, a pair of pants or another garment.

Figure 6:
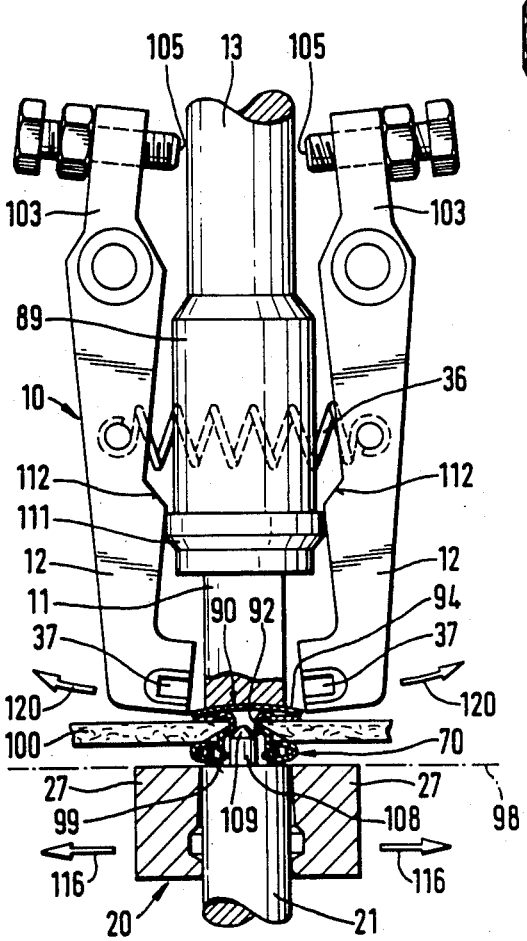
FIG. 6 illustrates the structure of FIG. 2 during attachment of the male component of an article of hardware to the female component on the anvil.

The improved press comprises a composite upper tool 10, 11, a composite lower tool 20, 21, and drive means (including an adapter 13 and an elongated motion transmitting rod 60) for moving the parts 10, 11 of the upper tool and the part 20 of the lower tool relative to each other as well as with reference to the part 21 of the lower tool. The part 10 of the upper tool constitutes a pair of tongs (hereinafter called tongs or upper tongs) having two jaws 12 which are movable relative to each other and serve to releasably hold the male component 90 of an article of hardware a portion of which is to penetrate through the sheet-like article 100 and thereupon into the complementary female component 70 with attendant deformation of at least one of these components so that the deformed component is more or less permanently secured to the other component. The other part 11 of the first tool is a ram which is in line with the larger-diameter upper portion of the component 90 between the jaws 12 of the upper tongs 10 and is movable relative to the jaws 12 toward and away from the stationary part 21 (hereinafter called anvil) of the lower tool. The part 20 of the lower tool comprises or constitutes a second pair of tongs (hereinafter called second or lower tongs) including two relatively movable jaws 27 which can releasably hold a female component 70 in an optimum position for deposition on the anvil 21 preparatory to movement of the ram 11 to the lower end position which is shown in FIG. 6. At such time, a central opening 71 (see FIG. 2) of the component 70 receives a centering projection or stud 108 which extends upwardly beyond the upper side or end face 99 of the anvil 21. The latter is installed in the frame 22 of the riveting press.

The drive means for moving the ram 11 and the tongs 10, 20 relative to each other as well as with reference to the anvil 21 comprises a first unit which can move the ram 11 up and down toward and away from the anvil 21 and includes an adapter 13 which is threadedly or otherwise connected to the ram 11 and whose upper end portion is removably installed in the lower end portion of an elongated link 14. The upper end portion of the link 14 is articulately connected with one arm of a two-armed lever 16 by a short link 17, and the lever 16 is pivotable about the horizontal axis of a pivot member 15 in the form of a shaft which is journalled in or is fixedly secured to the frame 22. The other arm of the lever 16 is articulately connected to a strap 18 surrounding the eccentric 19 of a drive shaft 19A which receives torque from suitable prime mover 150 (e.g., a variable-speed electric motor). The directions in which the adapter 13 reciprocates the ram 11 in response to rotation of the shaft 19A in the direction of the arrow 31 is indicated by the double-headed arrow 30. The throw of the eccentric 19 is such that the ram 11 performs strokes of considerable length (note the arrow 97 which is shown in FIG. 2 and denotes the amplitude of reciprocatory movement of the adapter 13, link 14 and ram 11).

The jaws 12 of the upper tongs 10 are secured to a plate-like carrier 33 by horizontal pivot pins 32 so that their lower portions or grippers can move toward and away from each other in and counter to the directions indicated in FIG. 6 by the arrows 120. The grippers of the jaws 12 carry stud-shaped retainers 34 movable in suitable marginal cutouts or notches 35 of the carrier 33 and coupled to each other by a coil spring 36 serving as a means for yieldably urging the lower end portions of the jaws 12 toward each other so that the grippers of such jaws can releasably but reliably hold a male component 90. The grippers of the jaws 12 have mirror symmetrical sockets 37 which can receive the larger-diameter portion of a component 90 in a manner as shown in FIG. 2 so that a hollow tubular shank 92 of the component 90 extends downwardly and is ready to penetrate through the workpiece 100 (which then rests on the lower tongs 20) in response to downward movement of the ram 11 with the adapter 13.

The aforementioned drive means further comprises a unit which serves to move the tongs 10 relative to the tongs 20, ram 11 and anvil 21, and such moving means comprises a bracket 38 provided on or forming an antigral part of the carrier 33 and connected with the lower end of a motion transmitting rod 39. The construction of the moving means including the rod 39 is or can be identical with that disclosed in German Offenlegungsschrift No. 25 56 516. The upper end portion of the rod 39 is articulately connected to one end of a composite lever having a first L-shaped section 40 and a second L-shaped section 41. The section 40 is pivotable about the axis of a horizontal pivot member 42 which is mounted in the frame 22. The upper end portion of the rod 39 is secured to the free end of the substantially horizontal first arm of the section 40, and the substantially vertical downwardly extending second arm 48 of the section 40 carries one contact 50 of a normally closed electric switch. The other contact 51 of the switch is provided at the lower end of the substantially vertical first arm 49 of the second section 41. The latter is pivotable about the axis of a horizontal pivot member 43 which is mounted on an extension or lug 44 of the substantially horizontal arm of the section 40. The substantially horizontal arm of the second section 41 of the composite lever carries a roller follower 45 which tracks the face of a disc cam 47 on the shaft 19A. A coil spring 46 or other suitable biasing means is provided to urge the roller follower 45 against the face of the cam 47. The substantially vertical arms 48, 49 of the sections 40, 41 are normally held in contact with or close to each other (as shown in FIG. 1) so that the contacts 50, 51 complete an electric circuit (including the conductors 50A, 51A) for the prime mover 150 of the riveting press. The means for urging the arms 48, 49 to the positions which are shown in FIG. 1 can include one or more coil springs (not specifically shown). The switch including the contacts 50, 51 constitutes an element of a safety device which reduces the likelihood of injury to the operator and the likelihood of damage to the machine and/or improper application of the components 70, 90 to each other and to the workpiece 100 when the improved press is in actual use.

Figure 2:
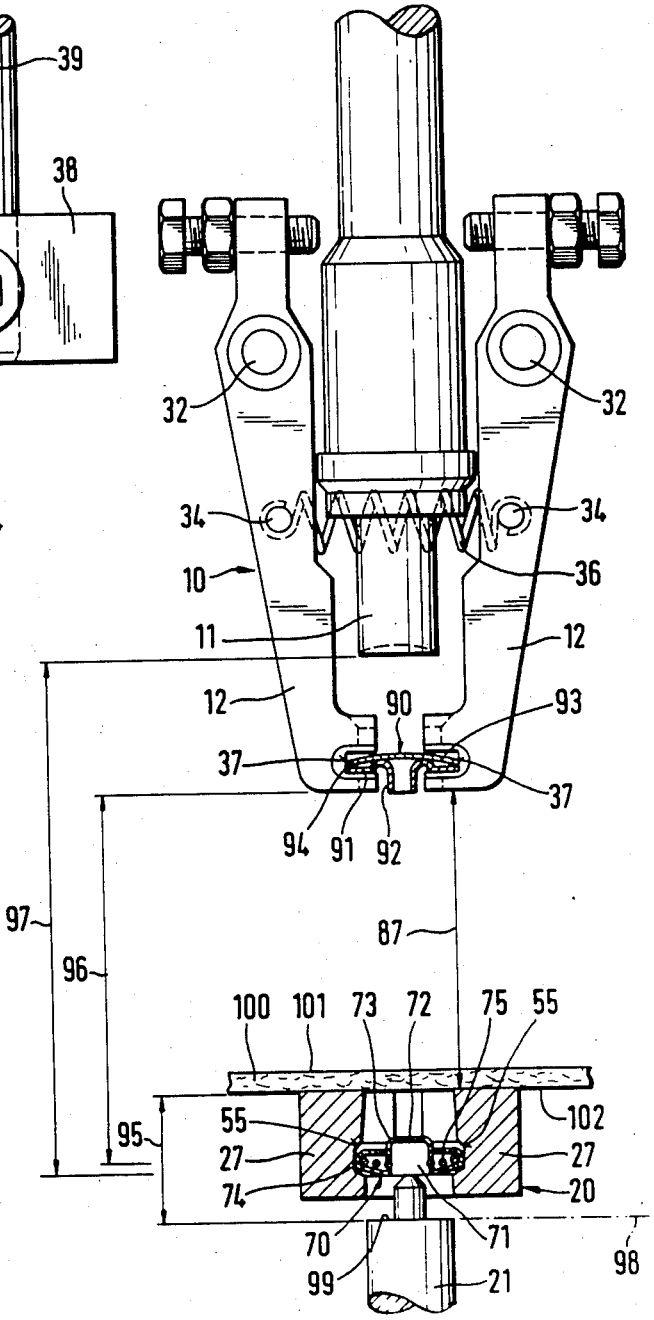
FIG. 2 is an enlarged front elevational view of a detail in FIG. 1, with the first tongs turned through 90 degrees relative to their positions in FIG. 1.
Figure 5:
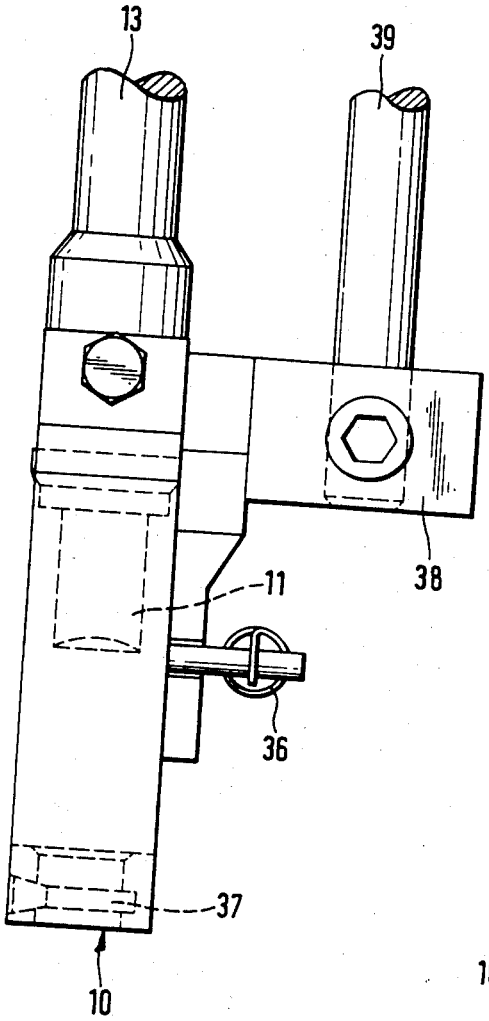
FIG. 5 illustrates the structure of FIG. 3 but with the first tongs at a level below that of FIG. 3.

When the prime mover 150 is on to drive the shaft 19A in the direction of the arrow 31, the ram 11 performs the aforedescribed strokes (with an amplitude 97) in directions indicated by the arrow 30, and the tongs 10 normally performs its own strokes (the amplitude of such strokes is shown in FIG. 2, as at 96) in directions indicated by the double-headed arrow 52. The movements of the tongs 10 are out of phase with movements of the ram 11; the purpose and the extent of such movements of the tongs 10 and ram 11 relative to each other will be described in greater detail with reference to FIGS. 2 to 7 in connection with the description of the mode of operation of the riveting press.

The aforedescribed drive means further comprises a unit which serves to reciprocate the lower tongs 20 relative to the anvil 21 as well as relative to the upper tongs 10 and ram 11. Such unit comprises an elongated arm 23 one end portion of which is pivotable about the axis of a horizontal pivot member 24 which is mounted in the frame 22. The other end of the arm 23 carries a connecting member 25 for a mobile support or platform 26 which, in turn movably supports the jaws 27 of the tongs 20. The jaws 27 are pivotable about the axes of substantially vertical pivot pins 28 (see, for example, FIG. 12) and carry downwardly extending stud-shaped retainers 29 for the end convolutions of a coil spring 54 (see particularly FIGS. 9 to 11). The spring 54 is located at the underside of the platform 26; therefore, the platform is formed with elongated slots 53 for the retainers 29. The extent of movability of the jaws 27 relative to the platform 26 and with reference to each other can be determined by the surfaces at the ends of the respective slots 53. The coil spring 54 yieldably urges the free end portions or grippers of the jaws 27 toward each other and such free end portions or grippers are provided with mirror symmetrical sockets 55 which can receive the larger-diameter portion of a component 70 (see, for example, FIG. 2). The platform 26 is formed with an additional slot or recess 56.

The directions in which the tongs 20 are movable relative to the anvil 21 are indicated by a double-headed arrow 57, and the amplitude of such movements is shown in FIG. 2, as at 95. The unit which includes the arm 23 and serves to reciprocate (actually pivot) the tongs 20 relative to the anvil 21 derives motion from the eccentric 19 through the medium of the two-armed lever 16. To this end, an intermediate portion of the arm 23 is articulately connected to the lower end portion 61 of a motion transmitting member 60 by a horizontal pivot pin 58, and the upper end portion 63 of the member 60 is connected to the left-hand arm (as viewed in FIG. 1) of the lever 16 by a second horizontal pivot pin 59. An intermediate part of the member 60 includes two portions **60*a*, 60*b* which are telescoped into each other or into a sleeve-like portion 62 and are urged apart by a coil spring 162. The part including the portion 62, 60*a* and 60*b* enables the motion transmitting member 60 to change its effective length while the riveting press is in actual use. The reciprocatory or pivotal movements of the lower tongs 20 are in phase with the movements of the ram 11. The member 60 further comprises an internally threaded nut 64 which is rotatably mounted on the end portion 63 and can move toward and away from the section 60*a*. The end portion 63 of the member 60 is axially movable in the bore of a sleeve 59A which is turnable on the pivot 59 (i.e., relative to the left-hand arm of the lever 16). A prestressed coil spring 65 operates between a stop 63A at the upper end of the end portion 63 and the sleeve 59A so as to urge the nut 64 against the underside of the sleeve 59A. This arrangement allows for a change in the length of the member 60. The nut 64 can be fixed in a selected position by a lock nut 64A**.

The feeding means 68 for supplying female components 70 into the sockets 55 of the jaws 27 of the lower tongs 20 comprises an elongated channeled guide member 66 for a reciprocable pusher 67 which performs forward and return strokes in order to allow a fresh component 70 to enter the guide member 66 in response to completion of a return stroke and to cause such component to enter the sockets 55 on completion of the next-following forward stroke. Each component 70 is made of sheet metal and includes a cupped upper portion 73 (as viewed in FIG. 2) having a bottom wall with a centrally located passage 72 communicating with the opening 71. The lower part of the cupped portion 73 has a radially outwardly extending rim or flange 74 for reception of resilient retaining or clamping elements 75. The innermost parts of the clamping elements 75 extend radially inwardly into the opening 71 through openings (e.g., slots) in the cylindrical or tubular part of the cupped portion 73 so that they can engage the centering stud 108. The exact construction of the components 70 and 90 forms no part of the invention. For example, such components can be similar with or identical with those disclosed in the commonly owned copending patent application Ser. No. 729,616 filed May 2, 1985 or in the commonly owned copending patent application Ser. No. 655,048 filed Sept. 26, 1984.

The feeding means 68 further comprises a magazine (not shown) for a supply of female components 70, a chute 69 which delivers properly oriented components 70 into the range of the pusher 67, and a suitable orienting or shaking device for ensuring that each component 70 which has entered the upper end of the chute 69 is held in a predetermined orientation so that the passage 72 is located at its upper end when it enters the channel of the guide member 66. This can be readily seen in FIG. 11 which shows the lower end portion of the chute 69. The aforementioned orienting or shaking device can be similar to those used for the orientation of crown corks in bottle capping machines.

Figure 10:
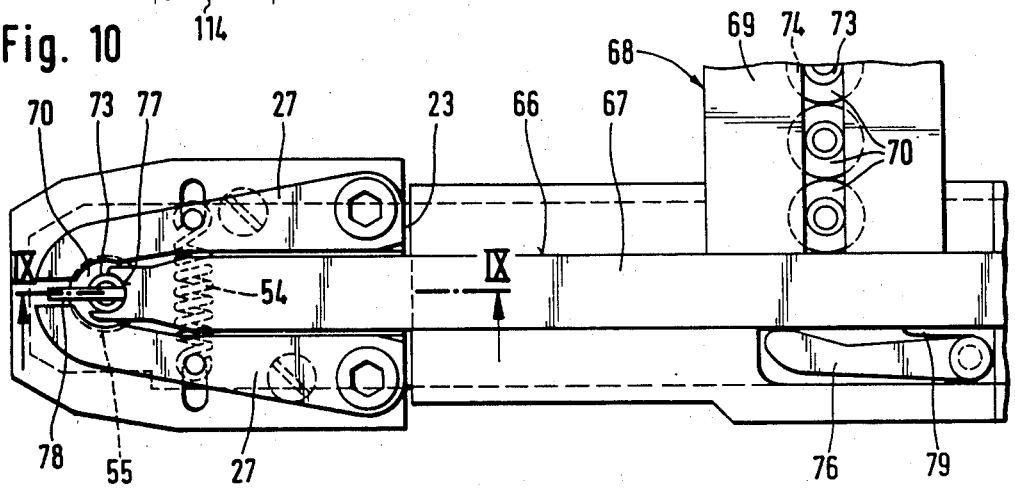
FIG. 10 is a plan view of the second tongs and of a portion of the means for feeding female components into the sockets of the jaws of the second pair, the pusher which is used to advance successive female components between the jaws of the second pair being shown in the extended position.
Figure 11:
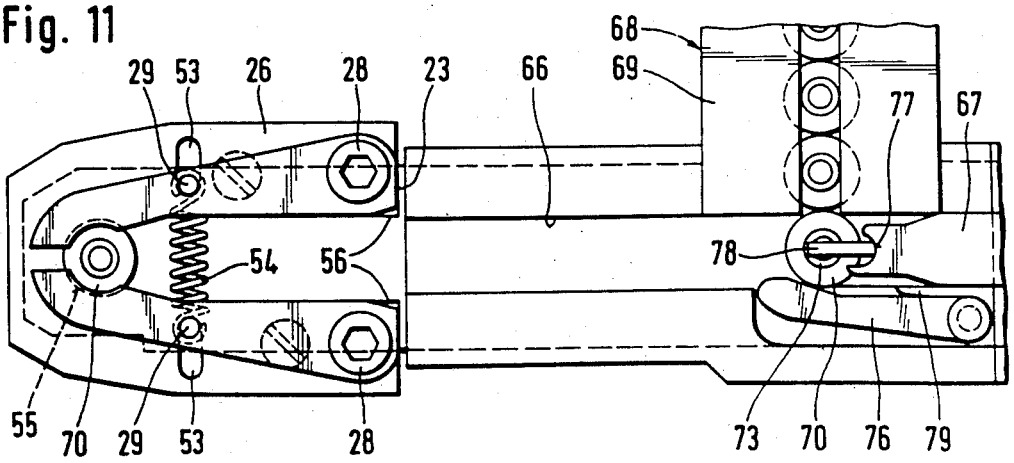
FIG. 11 illustrates the structure of FIG. 10 but with the pusher in the retracted position.

The top wall of the guide member 66 has a longitudinally extending slot, and the member 66 receives successive components 70 in such a way that the flanges or rims 74 of these components are disposed at a level below the respective passages 72. The smaller-diameter cupped upper portion 73 of the component 70 in the guide member 66 is located in and is slidable along the slot in the top wall of the member 66. A spring-biased locating pawl 76 (see particularly FIGS. 10 and 11) is mounted in the guide member 66 adjacent to the discharge end of the chute 69 to arrest the foremost component 70 in an optimum position for engagement by the pusher 67 when the latter is held in the retracted position of FIG. 11. The path which is defined for female components 70 by the discharge end of the chute 69 preferably extends at right angles to the path of movement of components 70 in the guide member 66. The pawl 76 is mounted in a lateral cutout of the guide member 66, and its forward end portion can be depressed into such cutout by the component 70 at the forward end of the pusher 67 when the latter begins to perform a forward stroke. FIG. 10 shows the pawl 76 in the depressed or inoperative position in which its pallet bears against the respective side of the pusher 67. The means for urging the pawl 76 to the position of FIG. 11 comprises a coil spring, an elastic block or any other suitable biasing means. A stop 79 is provided to limit the extent to which the pawl 76 can enter the path which is defined by the guide member 66. The pusher 76 has a tip or prong 78 which can engage the smaller-diameter cupped portion 73 in the channel of the top wall of the guide member 66 to advance the respective component 70 in the guide member and toward and into the sockets 55 of the jaws 27. The guide member 66 cooperates with the prong 78 to ensure that the component 70 in the guide member 66 is held in a predetermined orientation on its way toward and into the sockets 55 as well that the flange 74 of such component is maintained at a predetermined level.

The mode of operation of the feeding means 68 is as follows:

When the mobile parts 10, 11 and 20 of the two tools reach the upper end positions which are shown in FIG. 2, the aforementioned slot 56 (FIGS. 9 and 11) of the platform 26 is in register with a tongue 80 which is provided at the underside of the pusher 67. At such time, the discharge end of the channel in the guide member 66 is in line with the sockets 55 of the jaws 27. The mechanism for reciprocating the pusher 67 (such mechanism can comprise a rack and pinion drive, a cylinder and piston assembly, a reciprocable armature or any other suitable reciprocating means) then causes the pusher 67 to perform a forward stroke (from the retracted position of FIG. 11 to the extended position of FIG. 10) and to thereby advance a discrete female component 70 along the channel of the guide member 66 and into the sockets 55 of the jaws 27. The spring 54 is caused to store energy during the last stage of forward stroke of the pusher 67 and thereupon contracts to move the suitably configurated inner sides of the jaws 27 into requisite engagement with the larger-diameter lower portion of the component 70 in the sockets 55. The locating pawl 76 is pivoted from the position of FIG. 11 to the position of FIG. 10 by the lower portion of the component 70 in the channel of the guide member 66 as soon as the pusher 67 begins its forward stroke, and the pawl 76 is thereupon held in the inoperative position of FIG. 10 until shortly before the pusher completes its return stroke. The front end of the pusher 67 has a recess 77 which is bounded by a concave surface for reception of the smaller-diameter upper portion 73 of the component 70 which is held by the pawl 76. The aforementioned prong 78 overlies the smaller-diameter portion 73 (i.e., the passage 72) of the component 70 in the channel of the guide member 66 during travel of the pusher 67 from the retracted position of FIG. 11 to the extended position of FIG. 10.

Figure 4:
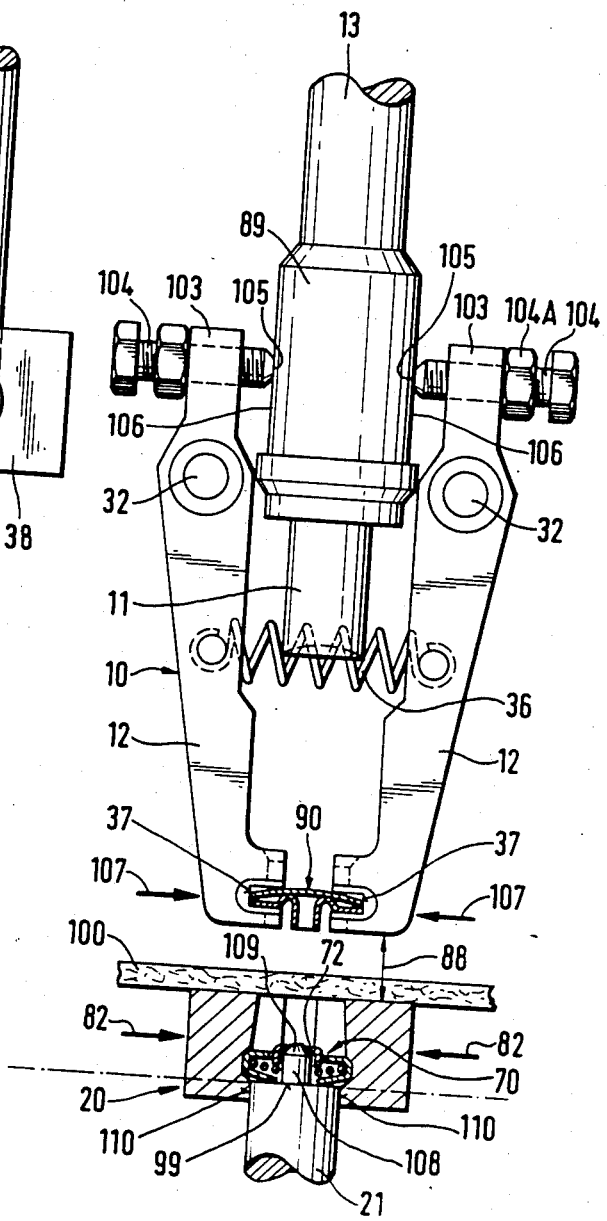
FIG. 4 illustrates the structure of FIG. 2 but with the two tongs and the ram in different positions relative to each other.
Figure 9:
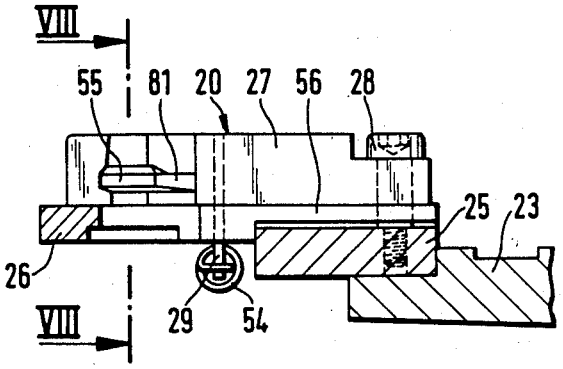
FIG. 9 is a fragmentary longitudinal vertical sectional view as seen in the direction of arrows from the line IX—IX of FIG. 10.

As can be seen in FIG. 9, the inner side of each of the jaws 27 is formed with a suitably configurated inlet 81 which guides the lower portion of a female component 70 on its way from the channel of the guide member 66 into the cavity which is defined therefor by the sockets 55. The height of the sockets 55 is selected in such a way that the component 70 is held therein at a predetermined level, i.e., that the smaller-diameter upper portion 73 of such component is located at a preselected distance from the upper sides of the jaws 27 (see FIG. 2). The spring 54 is caused to yield during advancement of a component 70 through the inlets 81 at the inner sides of the jaws 27. The jaws 27 are thereupon caused to snap to the positions of FIGS. 2 and 10 in order to reliably but releasably hold the freshly received component 70 in an optimum position for attachment to a component 90 in response to lowering of the ram 11. The directions in which the spring 54 biases the jaws 27 are indicated in FIG. 4 by arrows 82.

The pusher 67 is retracted from the extended position of FIG. 10 as soon as the component 70 is properly engaged by the surfaces bounding the sockets 55 of the jaws 27. The foremost (lowermost) component 70 can leave the discharge end of the chute 69 by gravity as soon as the pusher 67 reassumes the retracted position of FIG. 11, and such component 70 is arrested by the locating pawl 76 which is then free to extend into the channel of the guide member 66 to an extent which is determined by the stop 79.

Figure 12:
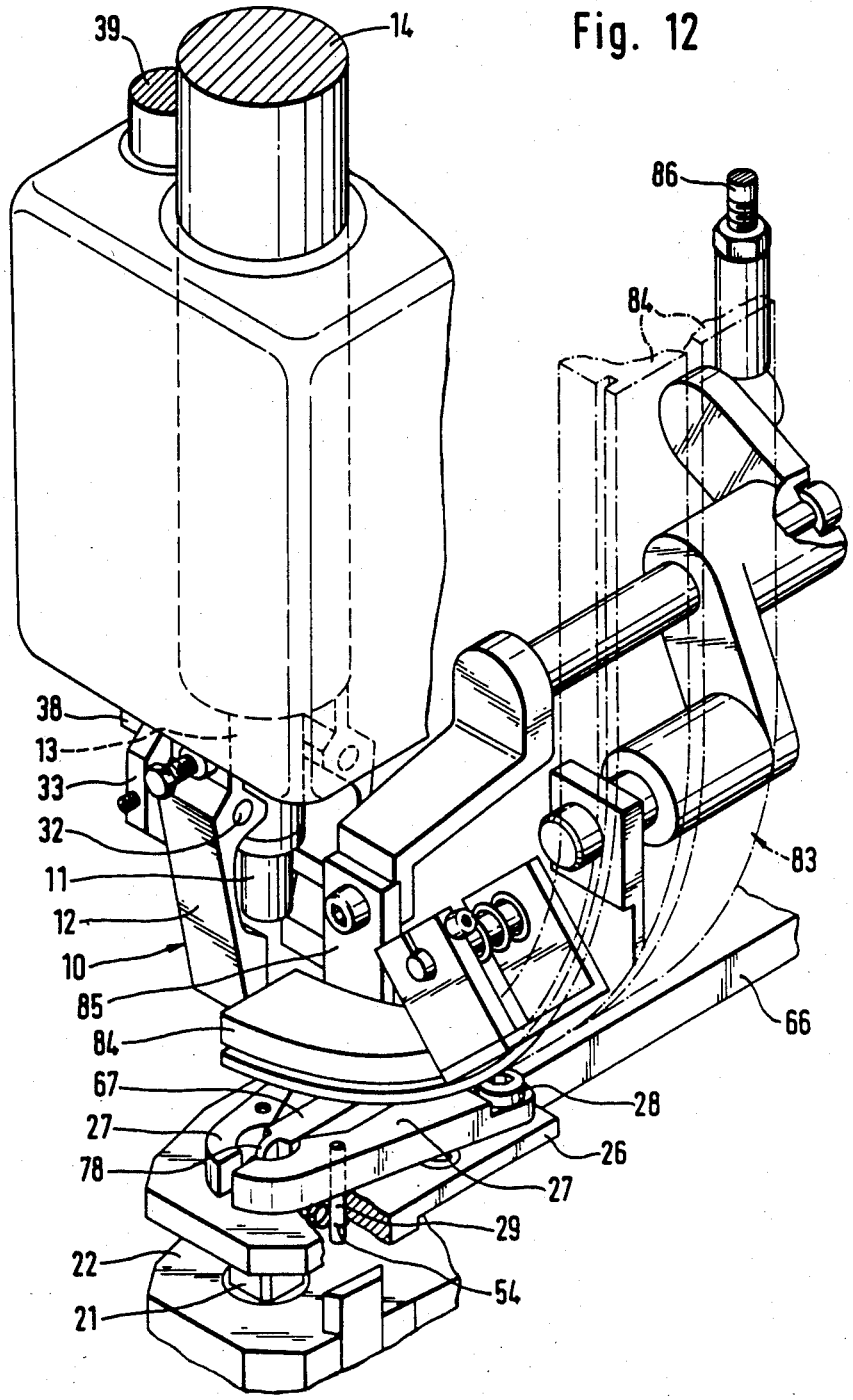
FIG. 12 is a fragmentary perspective view of the riveting press, showing the means for supplying components to the first and second tongs.

FIG. 12 shows certain details of the feeding means 83 for supplying male components 90 to the sockets 37 of the jaws 12. The feeding means 83 comprises a slotted chute 84 which receives a succession of properly oriented components 90 from a magazine, not shown, by way of a suitable shaking or orienting mechanism of any known design. Each component 90 resembles a portion of a rivet having a head 94 and the hollow shank 92 which extends downwardly from the underside of a flange 91 forming part of the head 94 when the component 90 is properly received and held between the jaws 12. The shank 92 undergoes deformation upon penetration into the upper portion 73 of the aligned female component 70. The head 94 further comprises a concavo-convex top portion 93 which overlies the flange 91. The channel of the chute 84 receives and guides the head 94 while the respective component 90 is in the process of descending toward and into the sockets 37 of the jaws 12. The lower end portion of the chute 84 carries a normally closed gate (e.g., in the form of a pivotable pawl resembling the pawl 76) which temporarily retains the lowermost component 90 in the path of movement of a pivotable expelling member 85 which is rocked back and forth by a mechanism 86 so as to transfer the lowermost component 90 from the horizontal discharge end of the chute 84 into the sockets 37. The thus transferred component 90 then temporarily stresses the coil spring 36 which yields and allows the grippers at the lower ends of the jaws 12 to move apart so as to allow for entry of the head 94 of the freshly transferred component 90 into the sockets 37. The component 90 whose head 94 extends into the sockets 37 is held in a predetermined orientation as well as at a predetermined level during the respective stage of movement of the upper tongs 10 under the action of the moving means including the rod 39. At such time, the component 90 between the jaws 12 is properly aligned with the ram 11.

As can be seen in FIG. 2, the jaws 12 releasably hold the head 94 of a component 90 while the tongs 10 are held in the upper end position, and the jaws 27 properly hold the enlarged portion of a component 70 while the tongs 20 are held in the upper end position. Even in such upper end positions of the tongs 10 and 20, the undersides of the jaws 12 and the upper sides of the jaws 27 define a space 87 whose width or height is amply sufficient for insertion of a workpiece 100. Such relatively wide space 87 is desirable and advantageous if the operator is to change the position of an article of clothing which is to be provided with a button, a rivet or a like article of hardware consisting of a component 70 at one side and a component 90 at the other side of the workpiece. The hollow shank 92 of the male component 90 is caused to penetrate through the workpiece 100 and to enter the smaller-diameter portion 73 of the lower component 70 not later than when the ram 11 reaches its lower end position. The upper side or surface 101 of the workpiece 100 resting on the upper sides of the jaws 27 (FIG. 2) is provided with customary indicia serving to facilitate the application of articles of hardware in optimum positions. Thus, the indicia can be readily observed by the person in charge of moving the workpiece 100 to a predetermined position with reference to the stationary anvil 21 and reciprocable ram 11. The normally unmarked rear side or underside 102 of the workpiece 100 rests on the jaws 27.

The axis of the ram 11 is aligned with or is in at least substantial register with the axis of the anvil 21. Moreover, the axis of the ram 11 is aligned or in substantial register with the components 90 and 70 which are respectively held by the tongs 10 and 11 to thus ensure that the shank 92 of the component 90 will penetrate into the passage 72 at the upper end of the component 70 therebelow. The extent of up-and-down movements of the ram 11, jaws 12 and jaws 27 relative to the anvil 21 (strokes 97, 96 and 95 in FIG. 2) can be readily ascertained by comparing the levels of such parts in FIG. 2 (upper end positions of the tongs 10, 20 and ram 11) with those in FIG. 6 (lower end positions of 10, 11 and 20). The horizontal broken line 98 denotes in FIG. 2 the level of the top face or upper side 99 of the anvil 21. The extent of reciprocatory movement of the tongs 10 (stroke 96) is less than the extent of reciprocatory movement of the ram 11 (stroke 97) but exceeds the extent of reciprocatory movement of the tongs 20 (stroke 95).

FIG. 4 shows the tongs 10, 20 and the ram 11 in intermediate positions. The jaws 27 have descended to lower the component 70 onto the upper side 99 of the stationary anvil 21. The difference between the levels of the tongs 10 in FIGS. 2 and 4 is greater than that between the levels of the tongs 20 so that width of the space 87 (FIG. 2) between the upper side of the tongs 20 and the underside of the tongs 10 is reduced to 88 (FIG. 4). The narrowed space 88 can be called a safety distance or safety gap which is designed to reduce the likelihood of or to prevent injury to a careless operator. The shank 92 of the male component 90 is close to but is still spaced apart from the upper side 101 of the workpiece 100 which rests on the upper side of the tongs 20 and overlies the female component 70 on the upper side 99 of the anvil 21.

The extent of downward movement of the ram 11, while the tongs 10 descends from the level of FIG. 2 to the level of FIG. 4, is less than that of the tongs 10 so that the distance between the underside of the ram and the male component 90 between the grippers of the jaws 12 increases. This is due to the fact that, while the ram 11 descends from the level of FIG. 2 under the action of the eccentric 19, the roller follower 45 tracks a rather pronounced lobe of the disc cam 47 and causes the tongs 10 to rapidly descend with reference to the descending ram 11. Once the tongs 10 reach the intermediate level of FIG. 4, the roller follower 45 begins to track a cylindrical portion of the face of the cam 47 so that the level of the tongs 10 remains unchanged for a certain interval of time which is sufficient to enable the descending ram 11 to catch up with the tongs 10.

The width (FIG. 4) of the safety gap 88 between the upper side of the workpiece 100 on the tongs 20 and the underside of the tongs 10 is less than the thickness of a finger of the person in charge of manipulating the workpiece relative to the anvil 21. Consequently, once the tongs 10 have descended to the level of FIG. 4, the operator cannot insert her or his finger into the gap 88. If a finger happens to be located in the space between the workpiece 100 on the tongs 20 and the underside of the tongs 10, while the tongs 10 are in the process of descending toward the level of FIG. 4, the jaws 12 cannot reach such level because the section 41 of the composite lever 40, 41 moves relative to the arrested section 40 and the contact 51 moves away from the contact 50 to open the circuit of the prime mover 150 and to thus arrest the shaft 19A. The switch including the contacts 50, 51 preferably further actuates a brake 250 (indicated schematically in FIG. 1) which immediately arrests the output element of the prime mover 150. Alternatively, the brake 250 can be used to arrest the shaft 19A as soon as the switch including the contacts 50, 51, opens the circuit of the prime mover 150. All that counts is to ensure that the shaft 19A is arrested before the ram 11 can descend to a level at which a finger above the workpiece 100 could be pinched between the jaws 12 and 27 and/or between the anvil 10 and ram 11. Any foreign object (e.g., a finger or the entire hand of the operator) between the workpiece 100 and the descending tongs 10 causes the switch including the contacts 50, 51 to open because the section 41 pivots relative to the section 40 and/or because the section 40 is caused to pivot relative to the section 41. At any rate, the mutual inclination of the downwardly extending arms 48, 49 of the sections 40, 41 changes so that the circuit of the motor 150 is opened and the riveting press comes to a halt. The just discussed safety device of the riveting press practically excludes the likelihood of serious injury to the hand of a careless operator.

As mentioned above, the arms 48, 49 of the sections 40, 41 of the lever in the motion transmitting connection between the tongs 10 and the cam 47 are biased to the mutual positions of FIG. 1 by one or more springs, by gravity and/or in any other suitable way so as to normally close the switch including the contacts 50, 51. Thus, the switch closes automatically as soon as a foreign object between the workpiece 100 on the tongs 20 and the tongs 10 is removed so that the motor 150 is started again and the operation of the riveting press is resumed.

The relatively short extensions or legs 103 of the jaws 12 above the respective pivot pins 32 include adjustable motion receiving members in the form of substantially horizontal bolts 104 whose axial positions can be fixed by lock nuts 104A and whose pointed tips 105 extend into the path of downward movement of an enlarged spreading device or boss 89 on the adapter 13. The boss 89 can form part of the ram 11 without departing from the spirit of the invention. The peripheral surface 106 of the boss 89 engages the tips 105 of the bolts 104 while the tongs 10 rapidly descend with reference to the ram 11 whereby the sockets 37 in the grippers of the jaws 12 are held at an optimum distance from each other to reliably hold the head 94 of the component 90 against changes in orientation relative to the tongs 10. The component 90 is held in the sockets 37 because the grippers of the jaws 12 are urged toward each other by the coil spring 36 as well as because the peripheral surface 106 of the boss 89 is located between the tips 105 of the motion receiving bolts 104. The directions in which the spring 36 biases the grippers of the jaws 12 are indicated by arrows 107 (FIG. 4).

Figure 8:
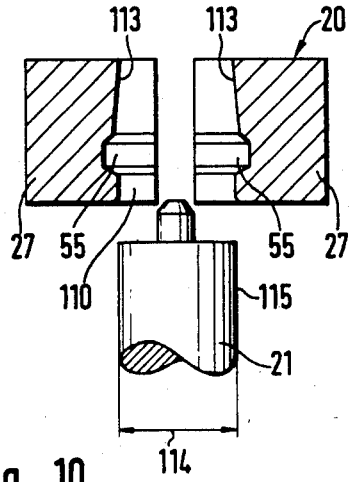
FIG. 8 is an enlarged vertical sectional view of the jaws of the second pair without a female component in their sockets and of a cylindrical portion of the anvil in line with the cylindrical inlet of the second tongs, the section being taken in the direction of arrows as seen from the line VIII—VIII of FIG. 9.

When the jaws 27 of the lower tongs 20 reach the intermediate positions of FIG. 4, i.e., when the female component 70 rests on the upper side 99 of the anvil 21, the centering stud 108 of the anvil extends into the component 70 from below to ensure that such component is held in an optimum orientation preparatory to penetration of the shank 92 of the aligned male component 90 through the workpiece 100 and into the passage 72. The upper end of the stud 108 is preferably provided with a conical tip 109 to facilitate penetration of the stud into the passage 72 of the portion 73 of the component 70 which is in the process of descending from the level of FIG. 2 to the level of FIG. 4. The spring 54 continues to bias the jaws 27 in the directions of arrows 82 (FIG. 4) so that the component 70 is compelled to share the downward movement of the tongs 20 from the level of FIG. 2 to the level of FIG. 4. Thus, the enlarged lower portion of the component 70 continues to be held in and to be properly oriented by the surfaces surrounding the sockets 55 of the jaws 27. The sockets 55 are disposed at a level above a substantially cylindrical inlet 110 (FIG. 8) which is provided in the lower portions of the jaws 27 and whose diameter matches the diameter 114 of the cylindrical upper portion of the anvil 21 while the tongs 20 descend toward the level of FIG. 4. Thus, the anvil 21 cannot interfere with such downward movement of the jaws 27 and of the component 70 therebetween. The surface surrounding the inlet 110 in the lower parts of the jaws 27 ensures that the entire tongs 20 are properly centered with reference to the anvil 21 during that stage of a cycle which precedes the penetration of the shank 92 through the workpiece 100 and into the passage 72 of the component 70.

The configuration of the face on the cam 47 is such that the ram 11 descends relative to the tongs 10 during movement from the level of FIG. 4 toward and to the level of FIG. 6. This enables the concave underside of the ram 11 to engage the convex upper side of the component 90 and to thereupon push the shank 92 into and through the workpiece 100 and into the passage 72 of the component 70 which is centered by the stud 108. FIG. 6 shows the tongs 10 in the lower end position. The underside of the ram 11 engages the upper side of the component 90 between the jaws 12 shortly before the tongs 10 complete their downward stroke. At such time, the boss 89 of the adapter 13 has descended to a level below the tips 105 of the bolts 104 so that the grippers at the lower ends of the jaws 12 can be moved apart against the opposition of the coil spring 36. The confronting inner sides or edge faces 112 of the jaws 12 at a level below the pivot pins 32 are then engaged and moved apart by a spreading collar 111 of the adapter 13 so that the coil spring 36 is caused to store energy and the sockets 37 move away from the head 94 of the component 90. The directions in which the sockets 37 of the jaws 12 move apart under the action of the collar 111 are indicated by the arrows 120 (see FIG. 6). The descending ram 11 is then free to cause the shank 92 of the thus released component 90 to penetrate through the workpiece 100 and into the component 70 at the underside of the workpiece. The shank 92 is actually deformed by the tip 109 and thereupon by the cylindrical portion of the centering stud 108 on the anvil 21.

When the tongs 20 descend to the level of FIG. 6, the upper sides of the jaws 27 are substantially flush with the plane 98 of the upper side 99 of the anvil 21. The jaws 27 can but need not descend to a level below that of FIG. 6, i.e., their upper sides can be moved below the plane 98. The upper portions of the jaws 27 (above the respective sockets 55) have upwardly tapering frustoconical surfaces 113 (see particularly FIG. 8) which cooperate with the peripheral surface 115 of the anvil 21 to spread the jaws 27 apart while the tongs 20 descend from the level of FIG. 4 to the level of FIG. 6. This ensures that the jaws 27 are separated from the component 70 not earlier than when the latter is properly centered by the stud 108 and is supported by the upper side 99 of the anvil 21 preparatory to penetration of the shank 92 into the component 70 and into engagement with the stud 108. The maximum diameter (at the lower end) of the composite conical surface defined by the surfaces 113 of the jaws 27 above the sockets 55 can equal or approximate the diameter 114 of the anvil 21. The directions in which the jaws 27 are moved apart under the action of the peripheral surface 115 of the anvil 21 are indicated by arrows 116 (FIG. 6).

Deformation of the shank 92 by the centering stud 108 entails that the deformed shank is securely anchored in the female component 70 in that it engages the inner side of the bottom wall of cupped portion 73 of the component 70.

Figure 7:
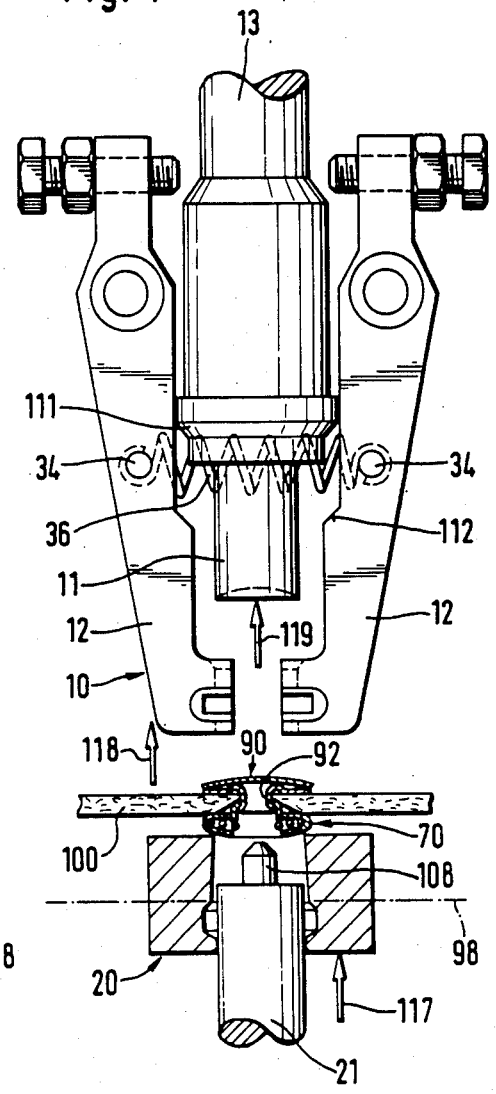
FIG. 7 illustrates the structure of FIG. 6 during upward movement of the tongs and of the ram toward the starting positions of FIGS. 1 and 2.

The actual riveting action is performed during the last stage of downward movement of the ram 11 relative to the anvil 21. At such time, the component 90 is already released by the jaws 12 and the component 70 is centered solely by the stud 108 and rests on the upper side 99 of the anvil 21. The thus obtained article of hardware is shown in FIG. 7, i.e., the lower part of the shank 92 is deformed radially and underlies that part of the cupped portion 73 which surrounds the passage 72. The presence of the opening 71 in the respective half of the article of hardware at the underside or inner side of the workpiece 100 is of no consequence since such opening cannot be seen when the article including the workpiece 100 is worn.

In the next step, the ram 11 and the tongs 10, 20 are lifted back to the starting positions of FIG. 2. FIG. 7 shows an intermediate stage of such upward movement. The tongs 20 have been moved in the direction of arrow 117 and the tongs 10 have been moved in the direction of arrow 118. The arrow 119 denotes the direction of upward movement of the ram 11. The rising tongs 20 strip the fully assembled article of hardware off the centering stud 108 so that the workpiece 100 is ready to be removed or to be shifted to a different position in which it is to be connected with a further pair of components 70, 90. It will be seen that the extent of upward movement of the ram 11 (arrow 119) and tongs 10 (arrow 118) exceeds the extent of upward movement of the tongs 20 (arrow 117) so that the jaws 12 move above and away from the workpiece 100 even though the latter shares the upward movement of the tongs 20.

The speed of upward movement of the ram 11 from the level of FIG. 6 to the level of FIG. 7 exceeds the speed of upward movement of the tongs 10 so that the spreading collar 111 of the adapter 13 is lifted above the confronting inner sides 112 of the jaws 12 whereby the spring 36 is again free to close the tongs 10, i.e., to move the jaws 12 nearer to each other in order to prepare the sockets 37 for reception of a fresh male component 90. The extent of movement of the jaws 12 toward each other under the action of the spring 36 is determined by suitable stops, such as by the aforediscussed surfaces bounding the recesses 35 in the carrier 33 for the retaining studs 34 which are connected to the respective end convolutions of the spring 36.

The tongs 10 and 20 are ready to receive fresh components 90 and 70 as soon as they reach the starting (upper end) positions of FIG. 2.

The feeding means 68 and 83 are disposed at right angles to each other in order to save space. Thus, the pusher 67 in the guide member 66 for components 70 reciprocates in directions at right angles to the plane of pivotal movement of the expelling member 85 for the components 90. The arrangement is preferably such that the pusher 67 performs forward strokes from the rear toward the front side of the riveting press whereas the expelling member 85 pivots back and forth in a plane which is parallel to the front side of the press. Therefore, the jaws 12 of the upper tongs 10 are located in a substantially vertical plane whereas the jaws 27 of the lower tongs 20 are located in a substantially horizontal plane, i.e., in a plane which is substantially normal to the plane of the upper jaws. This can be readily seen in FIG. 12. In FIGS. 2, 4, 6 and 7, the plane of the upper jaws 12 is turned through 90 degrees with reference to the plane of FIG. 12 for convenience of illustration. Thus, and referring to FIG. 6, the plane of the arrows 116 is actually disposed at right angles to the plane of the drawing and of the arrows 120.

Figure 3:
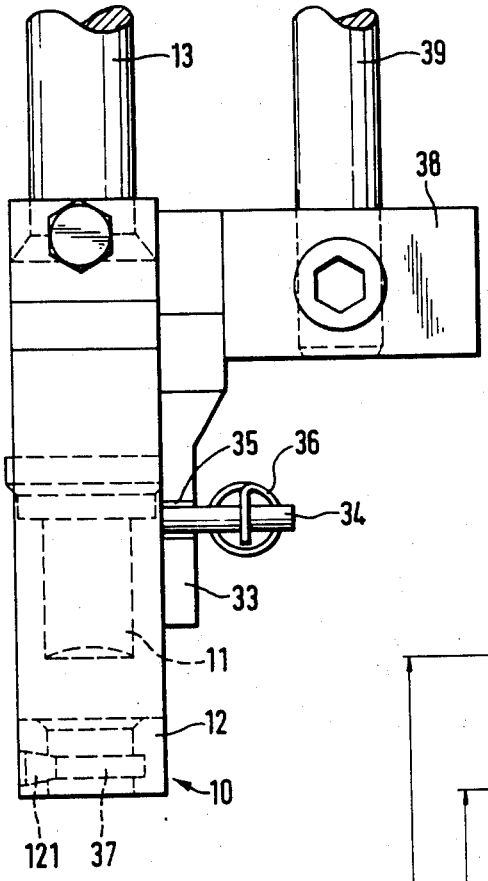
FIG. 3 is an enlarged rear elevational view of the first tongs, of the ram and of certain parts which move the first tongs and the ram, substantially as seen in the direction of arrow III in FIG. 1.

As shown in FIG. 3, the grippers of the jaws 12 of the upper tongs 10 are formed with suitably configurated inlets 121 which ensure proper guidance of successive male components 90 during their transfer by the expelling member 85 from the discharge end of the chute 84 into the sockets 37.

An important advantage of the improved riveting press is that the exposed side of the workpiece 100 (i.e., that side which is visible when the workpiece is converted into or constitutes a garment or the like) faces upwardly when the components 70, 90 of an article of hardware are being secured to each other and to the workpiece. This enables the operator to observe the customary indicia at the exposed side of the workpiece 100 and to shift the workpiece to an optimum position relative to the anvil 21 before the ram 11 descends to the position of FIG. 6 in order to cooperate with the centering stud 108 for the purpose of deforming the shank 92 of the male component 90 into engagement with the portion 73 of the female component on the upper side 99 of the anvil 21. Each of the components 70, 90 is held and oriented with a high degree of accuracy because the riveting press comprises two tongs, i.e., first tongs 10 for the male component 90 above the level of the workpiece 100 on the jaws 27 and second tongs 20 for the female component 70 at a level below the workpiece.

Another important advantage of the improved riveting press is that the means (115) for spreading the jaws 27 of the lower tongs 20 apart need not constitute a discrete part or unit but can form an integral portion of the anvil 21. Spreading of the jaws 27 takes place automatically at a most opportune moment, namely when the centering stud 108 is already received in the opening 71 of the female component 70 because the jaws 27 have descended to a level such that the underside of the component 70 can rest on the upper side 99 of the anvil 21.

A further important advantage of the improved press is that the means (23, 60) for moving the lower tongs 20 relative to the anvil 21 and with reference to the tongs 10 and ram 11 need not employ a discrete prime mover, i.e., such moving means can derive motion from the tongs 10 and/or from the ram 11. The provision of a motion transmitting member (60) whose effective length can be varied enables the lower tongs 20 to move relative to the ram 11 and relative to the upper tongs 10 and/or vice versa as well as to reduce the likelihood of serious damage to the machine in the event of malfunction or penetration of a foreign object into the riveting station.

The exact configuration of the surfaces bounding the sockets 37 and 55 as well as of the centering stud 108 and the underside of the ram 11 will depend on the dimensions and/or shape of the respective components and on the desired shape and/or dimensions of the assembled articles of hardware which can constitute buttons, rivets, hooks, eyelets and/or others. The components 70 and 90 can be made of a metallic material, of a synthetic plastic material or of a combination of different materials. The deformable portion of the component 90 can constitute a hollow shank (92), a solid pin, a set of claws or any other part which can penetrate through the workpiece and can be properly attached to the other component. The provision of a centering stud 108 which has a conical tip 109 is desirable and advantageous when the component 70 comprises the aforediscussed resilient elements 75 which are spread apart by the tip 109 while the component 70 descends relative to the stud so that the latter penetrates into the opening 71.

Still another important advantage of the improved riveting press is that the boss 89 can reliably hold the grippers of the jaws 12 against movement away from each other during the major part of each downward movement of the tongs 10 and ram 11. Furthermore, such boss preferably constitutes an element of the means for moving the ram 11 or a portion of the ram so that the grippers of the jaws 12 are invariably held against movement away from each other during predetermined stages of each cycle of the press. The exact timing of the start and termination of the blocking action can be selected by adjusting the positions of the bolts 104 relative to the respective extensions 103 of the jaws 12 and by thereupon fixing the bolts 104 in optimum positions by the respective lock nuts 104A.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A machine for securing complementary male and female components of articles of hardware to each other at opposite sides of sheet-like workpieces, comprising first tongs having a first pair of jaws for releasably holding one component of an article of hardware; a mobile support; second tongs having a second pair of jaws for releasably holding the other component of such article, said tongs having confronting surfaces which provide space for insertion of a workpiece therebetween; means for movably securing the jaws of said second pair to said support; an anvil in line with the component between the jaws of said second tongs; a ram in line with the component between the jaws of the first tongs; and drive means for moving said tongs and said ram relative to each other and with reference to said anvil so as to effect the penetration of the one component through the workpiece between said tongs and into engagement with the other component as a result of the movement of said ram toward said anvil, said drive means including means for moving said second tongs through the medium of said support said second pair of jaws having means for releasably holding the other component for movement with said second tongs in to abutment with said anvil.

2. The machine of claim 1, further comprising first feeding means for supplying discrete components between the jaws of said first tongs and second feeding means for supplying discrete components between the jaws of said second tongs in predetermined positions of the respective tongs, said first and second feeding means defining predetermined first and second paths for the respective components and at least a portion of one of said paths being inclined with reference to at least a portion of the other of said paths.

3. The machine of claim 2, wherein said portions of said paths are disposed at right angles to each other.

4. The machine of claim 1, wherein the jaws of said first pair are disposed in a first plane and the jaws of said second pair are disposed in a second plane which is inclined with reference to said first plane.

5. The machine of claim 4, wherein said planes are disposed at right angles to each other.

6. The machine of claim 4, wherein said first plane is substantially vertical and said second plane is substantially horizontal.

7. The machine of claim 1, wherein said means for moving said second tongs through the medium of said support comprises means for moving said second tongs downwardly so as to deposit the other component on said anvil and said drive means comprises means for thereupon lowering said ram and said first tongs so that the one component overlies the other component and the ram causes a portion of the male component to penetrate through the workpiece between said tongs and to engage the female component.

8. The machine of claim 7, further comprising means for spreading the jaws of said second tongs apart during downward movement of said second tongs so that the jaws of the second tongs release the other component while the latter is supported by said anvil.

9. The machine of claim 8, wherein said spreading means is provided on said anvil.

10. The machine of claim 8, wherein said anvil comprises means for centering the other component which is supported by said anvil.

11. The machine of claim 1, wherein the other component has a substantially centrally located opening and said anvil has upwardly extending means for centering the other component, said means for moving said second tongs being arranged to deposit the other component on said anvil so that said centering means extends into the opening of such component.

12. The machine of claim 11, wherein said ram is movable up and down relative to said anvil and the one component has a deformable portion which engages said centering means and is thereby deformed in response to downward movement of said ram toward said anvil.

13. The machine of claim 11, wherein said upwardly extending centering means comprises an upright stud having a substantially conical tip.

14. The machine of claim 13, wherein said anvil has an upper side and a cylindrical portion adjacent to said upper side, said stud being coaxial with the cylindrical portion of said anvil and extending upwardly beyond said upper side.

15. The machine of claim 1, wherein each jaw of said first tongs comprises a gripper provided with a socket for a portion of the one component and an extension, said first tongs further comprising a carrier for the jaws of said first tongs, pivot means for securing each jaw of said first tongs to said carrier intermediate the respective gripper and the respective extension, and means for yieldably urging said grippers toward each other, and further comprising means for blocking the movements of said grippers away from each other through the medium of said extensions during predetermined stages of movement of said first tongs.

16. The machine of claim 15, wherein said blocking means is provided on the drive means for moving said ram.

17. The machine of claim 15, wherein said blocking means comprises a boss which is arranged to share the movements of said ram relative to said anvil.

18. The machine of claim 15, wherein said drive means further comprises means for moving said first tongs and said ram up and down relative to said anvil and relative to each other, and said blocking means is arranged to prevent movements of said grippers away from each other during a predetermined stage of each movement of said ram toward said anvil.

19. The machine of claim 18, further comprising a safety device for preventing downward movement of said first tongs toward said anvil when the first tongs encounter an object other than a workpiece in the space between said first and second tongs.

20. The machine of claim 19, wherein said safety device comprises means for arresting said drive means in response to an interruption of downward movement of said first tongs as a result of the presence of an object in said space.

21. The machine of claim 1, wherein said second tongs and said anvil are located at a level below said first tongs and said ram.

22. The machine of claim 21, wherein the jaws of said first tongs have first sockets for portions of the one component, and said means for releasably holding the other component comprises second sockets for portions of the other component.

23. The machine of claim 22, wherein said second tongs further comprise means for yieldably urging said second sockets toward each other so that the surfaces surrounding such second sockets normally clamp the other component between the jaws of said second tongs.

24. The machine of claim 21, wherein said means for moving said second tongs through the medium of said support includes means for moving said second tongs up and down and said means for movably securing the jaws of said second pair to said support includes means for pivotably mounting such jaws on said support.

25. The machine of claim 24, wherein said drive means further comprises means for moving said ram and said first tongs, the means for moving said support deriving motion from the means for moving said ram.

26. The machine of claim 25, wherein the means connected to moving said support comprises an arm connected to said support, a pivot for said arm and means for pivoting said arm in response to predetermined stages of movement of said ram with reference to said anvil.

27. The machine of claim 26, wherein the means for moving said ram comprises a lever having a first arm coupled to said ram and a second arm, a pivot member for said lever and an eccentric coupled to and arranged to rock said second arm.

28. The machine of claim 26, wherein the means for pivoting said arm comprises an elongated motion transmitting member having portions which are slidably telescoped into each other so as to allow for changes in effective length of said motion transmitting member and for movements of said ram and said second tongs relative to each other.

29. A machine for securing complementary male and female components of articles of hardware to each other at opposite sides of sheet-like workpieces, comprising first tongs having a first pair of jaws for releasably holding one component of an article of hardware, each jaw of said first tongs comprising a gripper provided with a socket for a portion of the one component, and an extension, said first tongs further comprising a carrier for the jaws of said first tongs, pivot means for securing each jaw of said first tongs to said carrier intermediate the respective gripper and the respective extension, and means for yieldably urging said grippers toward each other; a mobile support; second tongs having a second pair of jaws for releasably holding the other component of an article, said tongs having confronting surfaces which provide space for insertion of a workpiece therebetween; means for pivotally securing the jaws of said second tongs to said support; an anvil in line with the component between the jaws of said second tongs; a ram in line with the component between the jaws of said first tongs, said second tongs and said anvil being located at a level below said first tongs and said ram; drive means for moving said tongs and said ram relative to each other and with reference to said anvil so as to effect the penetration of the male component through the workpiece between said tongs and into engagement with the female component as a result of the movement of said ram toward said anvil, said drive means including means for moving said second tongs up and down through the medium of said support; and means for blocking the movements of said grippers away from each other through the medium of said extensions during predetermined stages of movement of said first tongs, said blocking means comprising a boss which is arranged to share the movements of said ram relative to said anvil, said extensions including adjustable portions which are engaged by said boss while the latter blocks the movements of said grippers away from each other.

* * * * *